US007442483B2

(12) United States Patent
Kobayashi et al.

(10) Patent No.: US 7,442,483 B2
(45) Date of Patent: Oct. 28, 2008

(54) FERRITE CARRIER FOR ELECTROPHOTOGRAPHIC DEVELOPER AND METHOD FOR PREPARING THE SAME, AND ELECTROPHOTOGRAPHIC DEVELOPER USING THE SAME

(75) Inventors: Hiromichi Kobayashi, Kashiwa (JP); Kanao Kayamoto, Kashiwa (JP); Tadashi Harayama, Kashiwa (JP); Issei Shinmura, Kashiwa (JP); Toshio Honjo, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 38 days.

(21) Appl. No.: 11/167,293

(22) Filed: Jun. 28, 2005

(65) Prior Publication Data

US 2006/0003248 A1 Jan. 5, 2006

(30) Foreign Application Priority Data

Jun. 30, 2004 (JP) ..... 2004-193149

(51) Int. Cl.
*G03G 9/107* (2006.01)

(52) U.S. Cl. ..... 430/111.3; 430/111.31; 430/111.32

(58) Field of Classification Search ..... 430/111.33, 430/111.31, 111.32, 111.3
See application file for complete search history.

(56) References Cited

U.S. PATENT DOCUMENTS

| | | | | |
|---|---|---|---|---|
| 6,232,026 | B1 * | 5/2001 | Lambert | 430/111.33 |
| 6,723,481 | B2 * | 4/2004 | Lambert et al. | 430/122.3 |
| 7,144,669 | B2 * | 12/2006 | Suzuki et al. | 430/111.1 |

FOREIGN PATENT DOCUMENTS

| | | | |
|---|---|---|---|
| EP | 0 928 998 | * | 7/1999 |
| JP | 08-194338 | | 7/1996 |

* cited by examiner

*Primary Examiner*—Hoa V Le
(74) *Attorney, Agent, or Firm*—Rothwell, Figg, Ernst & Manbeck, P.C.

(57) ABSTRACT

A ferrite carrier for the electrophotographic developer containing 40 to 500 ppm of zirconium; a method for preparing a ferrite carrier for the electrophotographic developer, comprising the steps for weighing, mixing, and pulverizing ferrite raw materials, and for granulating, drying, and firing the obtained slurry; wherein a zirconium raw material is added so that the zirconium content after firing becomes 40 to 500 ppm; and an electrophotographic developer using the ferrite carrier.

4 Claims, 1 Drawing Sheet

FERRITE CARRIER FOR ELECTROPHOTOGRAPHIC DEVELOPER AND METHOD FOR PREPARING THE SAME, AND ELECTROPHOTOGRAPHIC DEVELOPER USING THE SAME

TECHNICAL FIELD

The present invention relates to a ferrite carrier for a two-component electrophotographic developer used in copiers, printers and the like, a method for preparing the same, and an electrophotographic developer using the ferrite carrier; and more specifically to a ferrite carrier for an electrophotographic developer that can suppress charge leakage because of high dielectric breakdown voltage, and as a result, produces high image quality, a method for preparing the same, and an electrophotographic developer using the ferrite carrier.

BACKGROUND ART

A two-component developer used in electrophotography is composed of a toner and a carrier, and the carrier is a carrying substance that is mixed with the toner under agitation in a developer box, provides a desired charge to the toner, carries the charged toner to an electrostatic latent image on a photoreceptor, and forms a toner image. The carrier is held by a magnet and is left on a developing roll even after forming the toner image and further returns to the developer box, and is again mixed and agitated with new toner particles, and repeatedly used for a certain period.

Since different from single-component developers, in the two-component developer, the carrier has functions to agitate toner particles, to provide desired charging properties to the toner particles, and to carry the toner; and has high controllability in the design of developers, it is widely used in the field of full-color machines wherein high image quality is required, and high-speed machines wherein the reliability of image preservation and durability are required.

In such a two-component electrophotographic developer, in order to obtain high-quality images, ferrite, such as Cu—Zn ferrite and Ni—Zn ferrite, is used as a carrier in place of oxide-film coated iron powder or resin-coated iron powder. Although these ferrite carriers have many advantageous characteristics for obtaining high-quality images compared with conventional iron-powder carriers, since the surface irregularities are uneven within the particles and between the particles, there is a problem of intense charge leakage particularly from the convex portions thereof, and high image quality is difficult to obtain.

For this reason, many attempts have been made to prevent charge leakage by imparting high resistance and high dielectric breakdown voltage to ferrite; however, these are insufficient. For example, in Japanese Patent Application Laid-Open No. 8-194338 or the like, a ferrite carrier containing an additive, such as zirconium oxide is disclosed, which is to control the surface properties, resistance and the like by adding the additive. However, it was difficult to disperse such an additive evenly in the ferrite, which promoted unevenness. When a large quantity of an additive was added to elicit its effect, for example, as described in "Electronic Material Series, Ferrite, p. 43, Table 3.2, Maruzen Co., Ltd.", the growth of grains was suppressed, or on the contrary, the reaction was excessively promoted to loose evenness, or to produce other defects.

Thus, although various attempts have been made to impart high dielectric breakdown voltage to ferrite carriers, and thereby provide high-quality images, satisfactory effects have not been obtained as described above.

DISCLOSURE OF THE INVENTION

Problems to be Solved by the Invention

Therefore, the object of the present invention is to provide a ferrite carrier for an electrophotographic developer that can suppress charge leakage because of high dielectric breakdown voltage, and as a result, produces high image quality; a method for preparing the same; and an electrophotographic developer using the ferrite carrier.

MEANS FOR SOLVING THE PROBLEMS

As a result of keen examinations, the present inventors found that it is desirable to raise electrical resistance and to reduce surface irregularities in order to obtain high dielectric breakdown voltage. The present inventors also found that it is desirable that a certain quantity of zirconium is contained and evenly dispersed in order to raise electrical resistance; and that it is effective to specify the upper limit of zirconium content, and to control the particle diameters in the slurry in the preparing process in order to reduce surface irregularities. The present invention has been devised on the basis of these findings.

Specifically, the present invention provides a ferrite carrier for the electrophotographic developer containing 40 to 500 ppm of zirconium.

In the above-described ferrite carrier for the electrophotographic developer according to the present invention, it is preferable that the composition of the ferrite is represented by the following Formula (1):

$$(MnOx(MgO)y(Fe_2O_3)z \quad (1)$$

(where x=35-45 mol %, y=5-15 mol %, z=40-60 mol %, and x+y+z=100 mol %)

It is more preferable that a part of (MnO) and/or (MgO) in the above Formula (1) is replaced by one or more oxides selected from SrO, $Li_2O$, CaO, TiO, CuO, ZnO and NiO.

It is preferable that the surface of the ferrite carrier for the electrophotographic developer according to the present invention is coated with a resin.

The present invention also provides a method for preparing a ferrite carrier for the electrophotographic developer, comprising the steps for weighing, mixing, and pulverizing ferrite raw materials, and for granulating, drying, and firing the obtained slurry; wherein a zirconium raw material is added so that the zirconium content after firing becomes 40 to 500 ppm.

In the inventive method for preparing a ferrite carrier for the electrophotographic developer, it is preferable that a zirconium raw material is added together with said ferrite raw material.

In the inventive method for preparing a ferrite carrier for the electrophotographic developer, it is preferable that beads containing zirconia beads for pulverizing, and zirconia mixed in due to the abrasion of said zirconia beads is used as the zirconium raw material.

In the inventive method for preparing a ferrite carrier for the electrophotographic developer, it is preferable that the particle diameters in the slurry are adjusted within the ranges shown in (1) to (3) below:

(1) slurry particle diameters (volume-average diameters): $D_{10}$=0.05-3.0 μm, $D_{50}$=1-3 μm, and $D_{90}$=2-4 μm;

(2) slurry particle diameters (number-average diameters): $D_{50}$=0.05-3.0 μm; and (3) content of particles having the slurry particle diameters (volume-average diameters) of 3 μm or larger is 40% by volume or less.

The present invention also provides an electrophotographic developer consisting of the above-described ferrite carrier and the toner.

ADVANTAGE OF THE INVENTION

Since the ferrite carrier for an electrophotographic developer of the present invention contains a trace amount of zirconium, the dielectric breakdown voltage of the carrier rises, and the occurrence of charge leakage can be suppressed. Therefore, high image quality can be achieved by a developer using this ferrite carrier. In addition, according to the preparing method of the present invention, the above-described ferrite carrier can be obtained at industrial-scale productivity.

BEST MODE FOR CARRYING OUT THE INVENTION

Figure 1:
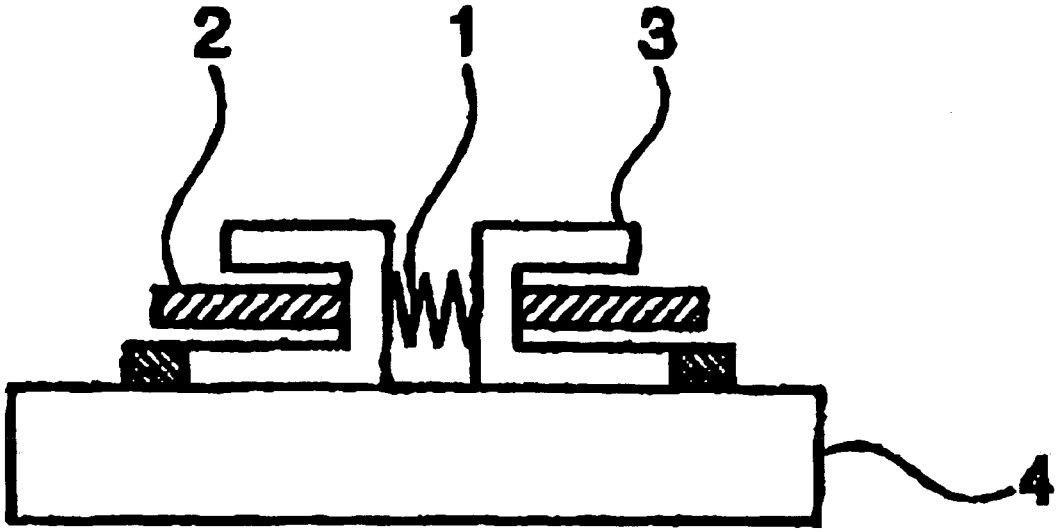
FIG. 1 is an illustrative diagram of a measuring jig used in resistance measurement.

The best mode for carrying out the present invention will be described below.

<Ferrite Carrier for Electrophotographic Developer According to Present Invention>

The ferrite carrier for an electrophotographic developer according to the present invention contains zirconium. The content is 40 to 500 ppm, preferably 50 to 150 ppm. A very small content of zirconium in the carrier can provide a high dielectric breakdown voltage and suppress charge leakage. If the content of zirconium is lower than 40 ppm, no containing effect can be obtained; and if the content exceeds 500 ppm, the growth of grain boundary is excessively suppressed, surface irregularities become intensified, and as a result, charge leakage from the convex portion occurs easily. Although ferrite contains zirconium as an accompanying impurity in the material or in the manufacturing process thereof, the content is normally less than 40 ppm.

Although the composition of the ferrite carrier for an electrophotographic developer according to the present invention contains zirconium is not specifically limited if it contains zirconium within the above-described range, it is preferable to have the composition of the following Formula (1).

$$(MnOx(MgO)y(Fe_2O_3)z \quad (1)$$

(where x=35-45 mol %, y=5-15 mol %, z=40-60 mol %, and x+y+z=100 mol %)

A part of (MnO) and/or (MgO) in the above Formula (1) can be replaced by one or more oxide selected from SrO, $Li_2O$, CaO, TiO, CuO, ZnO and NiO.

Since the ferrite of specific composition is highly magnetized, the uniformity of magnetization is high (the fluctuation of magnetization is small), and the dispersibility of zirconium is high, it is preferably used in the present invention.

It is preferable that the surface of the ferrite (carrier core material) in the ferrite carrier for an electrophotographic developer according to the present invention is coated with a resin, for the purpose to raise dulability and to obtain stable image characteristics for a long period of time. Various known resins can be used as the coating resin. The examples include a fluororesin, an acrylic resin, an epoxy resin, a polyester resin, a fluorinated acrylic resin, an acrylic styrene resin, and a silicone resin; or a modified silicone resin modified with various resins, such as an acrylic resin, a polyester resin, an epoxy resin, an alkyd resin, a urethane resin and a fluororesin.

The coating quantity of the resin to the quantity of the carrier core material is preferably 0.01 to 10.0% by weight, and more preferably 0.3 to 7.0% by weight. Most preferably, it is 0.5 to 5.0% by weight. If the coating quantity is less than 0.01% by weight, it is difficult to form a uniform coating layer on the surface of the carrier; and if the coating quantity exceeds 10.0% by weight, the aggregation of carrier to each other occurs, causing the lowering of productivity, such as the lowering of yield, as well as the variation of the characteristics of the developer, such as flowability and charge in actual machines.

Since the coated resin film receives large stress due to the agitation in the developing machine or collision to the doctor blade, it is easily delaminated and worn. The phenomenon of toner spent, wherein the toner adheres on the surface of the carrier, also occurs easily. In order to solve these problems, and to maintain stable developer characteristics for a long period, a resin containing the following formulas (I) and/or (II), which has good abrasion resistance, peeling resistance and spent resistance. By containing these, the effect for water repellence is obtained.

[Formula 1]

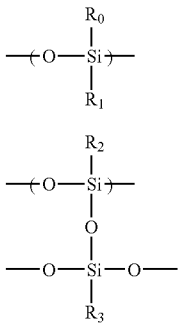

(I)

(II)

(In the formulas, each of $R_0$, $R_1$, $R_2$, and $R_3$ represents a hydrogen atom, a halogen atom, a hydroxyl group, a methoxy group, an alkyl group having 1 to 4 carbon atoms, or a phenyl group.)

The examples of resins containing the above formulas (I) and/or (II) include the above-described straight silicone resins, organic-modified silicone resins, and fluorine-modified silicone resins.

The above-described coating resin can contain a silane coupling agent as a charge controlling agent. This is because the charge ability may be lowered when the exposing area of the core material is controlled to be relatively small by coating; however, it can be controlled by adding various silane coupling agents. Although the kind of the silane coupling agent that can be used is not specifically limited, an aminosilane coupling agent is preferable in the case of a negative polar toner; and a fluorine-containing silane coupling agent is preferable in the case of a positive polar toner.

Electrically conductive fine particles can also be added to the above-described coating resins. This is because when coating is controlled so that the coating quantity of the resin becomes relatively large, absolute resistance may excessively rise and the developing ability may lower. However, since the resistance of electrically conductive fine particles themselves is lower than the resistance of coating resins or ferrite as the core material, and sharp charge leakage is caused when their loading is excessively large, the loading relative to the solid content of the coating resin is 0.25 to 20.0% by weight, preferably 0.5 to 15.0% by weight, and especially preferably 1.0 to 10.0% by weight. The examples of electrically conductive fine particles include electrically conductive carbon, oxides such as titanium oxide and tin oxide, and oxides of various organic electrically conductive agents and the like.

The average particle diameter of the ferrite carrier for an electrophotographic developer according to the present invention is preferably 20 to 100 μm, and more preferably 25 to 70 μm. If the average particle diameter is less than 20 μm, the adhesion of the carrier easily occurs causing white spots. If the average particle diameter exceeds 100 μm, the image quality is roughened, and desired resolution becomes difficult to obtain.

The average particle diameter is measured using a Microtrac particle size analyzer (Model 19320-X100) manufactured by Nikkiso Co., Ltd.

The resistance of the carrier core material according to the present invention is preferably $1\times10^4$ to $1\times10^{10}$ Ω, and more preferably $1\times10^5$ to $1\times10^9$ Ω. If the resistance of the carrier core material is lower than $1\times10^4$ Ω, charge leakage occurs easily causing white spots to be formed. If the resistance of the carrier core material exceeds $1\times10^{10}$ Ω, the resistance becomes excessively high, and the problem, such as the lowering of developing ability, arises easily. On the other hand, the resistance after resin coating is $1\times10^6$ to $1\times10^{13}$ Ω, and preferably $1\times10^9$ to $1\times10^{12}$ Ω. If the resistance of the carrier core material after resin coating is lower than $1\times10^6$ Ω, charge leakage occurs easily causing white spots to be formed. If the resistance of the carrier core material after resin coating exceeds $1\times10^{13}$ Ω, the resistance becomes excessively high, and the problem, such as the lowering of developing ability, arises easily.

The resistance of the carrier core material and the resistance after resin coating are measured using a measuring jig as shown in FIG. 1. In the drawing, reference numerals 1, 2, 3 and 4 denote a carrier (sample), a magnet, electrodes and an insulator (fluororesin plate), respectively. Specifically, 40 mg of the sample is weighed, and is inserted between parallel flat-plate electrodes (area: 10×40 mm) having the distance between electrodes of 6.5 mm. Then, the sample is held between the electrodes by making the N-pole and the S-pole of the magnet (surface flux density: 1500 Gauss, area of facing portions of the magnet: 10×30 mm) face each other, and attaching the magnet to the parallel flat-plate electrodes, and the resistance is measured using SM-8210 manufactured by DKK-TOA Corporation.

The specific surface area of the ferrite carrier for an electrophotographic developer according to the present invention is preferably 0.05 to 0.2 $m^2/g$, and more preferably 0.06 to 0.15 $m^2/g$. If the specific surface area is less than 0.05 $m^2/g$, the image quality is roughened, and desired resolution is difficult to obtain; and if the specific surface area exceeds 0.2 $m^2/g$, the image quality is worsened probably because the flowability is lowered.

The specific surface area of the carrier is measured using an automatic specific surface area measuring instrument, GEMINI 2360 (manufactured by Shimadzu Corporation) by adsorbing $N_2$ thereon, which is an absorbable gas.

The shape factor (SF-2) of the ferrite carrier for an electrophotographic developer according to the present invention is preferably 100 to 125, and more preferably 100 to 115. If the shape factor (SF-2) exceeds 125, the irregularities of the carrier surface is marked, and charge leakage from the convex portion occurs easily causing the formation of white spots and the deterioration of resolution.

The shape factor (SF-2) is calculated using the following equation:

$$\text{Shape factor (SF-2)}=L^2/S/4\pi\times100$$

(L: projective circumferential length, S: projective area)

The shape factor SF-2 is obtained by taking the photo of carrier particles through a scanning electron microscope, and analyzing the image using image-analyzing software, Image-Pro Plus (manufactured by Media Cybernetics). The shape factor is calculated for each particle, and the mean value of 50 particles is made to be the shape factor of the carrier. Here, the shape factor of 100 indicates perfect roundness.

The magnetization of the ferrite carrier for an electrophotographic developer according to the present invention is preferably 40 to 100 emu/g ($Am^2/kg$), and more preferably 50 emu/g ($Am^2/kg$). If the magnetization is less than 40 emu/g ($Am^2/kg$), carrier adhesion occurs easily causing the formation of white spots. If the magnetization exceeds 100 emu/g ($Am^2/kg$), the image quality is roughened and desired resolution is difficult to obtain, probably because the bristles of the magnetic brush is hardened.

The magnetization is measured using an integral-type B-H tracer, BHU-60 (manufactured by Riken Denshi Co., Ltd.). An H coil for measuring magnetic field and a 4πI coil for measuring magnetization are inserted between electromagnets. In this case, the sample is placed in the 4πH coil. Each of outputs of the H coil and the 4πI coil, of which magnetic field H is varied by varying the current of the electromagnets, is integrated, H outputs are spotted on the X axis and the outputs of the 4πI coil are spotted on the Y axis to draw a hysteresis loop on recording paper. Here, measurement is performed under the conditions of the sample quantity: about 1 g, the sample-filled cell: inner diameter of 7 mmϕ±0.02 mm, height of 10 mm±0.4 mm, and 4πI coil windings: 30.

The apparent density of the ferrite carrier for an electrophotographic developer according to the present invention is preferably 2.0 to 2.5 $g/cm^3$, and more preferably 2.1 to 2.4 $g/cm^3$. If the apparent density is less than 2.0 $g/cm^3$, the image quality becomes worse because flowability is worsened. If the apparent density exceeds 2.5 $g/cm^3$, the image quality is roughened and desired resolution is difficult to obtain, probably because the bristles of the magnetic brush is hardened.

The apparent density is measured in accordance with JIS-Z2504 (Method of Testing Apparent Density of Metal Powder).

<Method for Preparing a Ferrite Carrier for a Developer According to the Present Invention>

Next, a method for preparing ferrite carrier for a developer according to the present invention will be described.

First, after weighing an adequate quantity of ferrite raw materials so as to be a specified composition, it is ground and mixed in a ball mill, a vibration mill or the like for 0.5 hour or more, preferably 1 to 20 hours. After palletizing thus obtained ground material using a compression molding machine or the like, the pellets are preliminarily fired at a temperature of 700 to 1200° C. Instead of using the compression molding machine, the ferrite raw material can be granulated after grinding, producing slurry by adding water, and spray-drying the slurry. When the apparent density is lowered, the step of preliminary firing can be omitted.

After preliminary firing, the ferrite raw material is further ground using a ball mill or a vibration mill, water and, as required, a dispersant, a binder and the like are added, and after adjusting viscosity, the material is palletized, the oxygen concentration is controlled, then the material is allowed to stand for 1 to 24 hours at a temperature of 1000 to 1500° C., and final firing is performed. When grinding after preliminary firing, the material can be ground using a wet ball mill or a wet vibration mill after adding water.

In the preparing method according to the present invention, a zirconium raw material is added so that the zirconium content after firing (final firing) becomes 40 to 500 ppm.

The zirconium raw material is usually added together with ferrite raw materials. Such ferrite raw materials includes zirconium oxide and the like.

Although grinding machines, such as a ball mill and a vibration mill, used in above-described grinding is not specifically limited, in order to disperse zirconium effectively and evenly into ferrite, it is desired to use beads containing zirconia beads in the media to be used.

Thereby, zirconium can be evenly dispersed, even when the zirconium raw material is previously added as described above; and fine zirconium oxide particles can be evenly dispersed into the ferrite composition due to the abrasion of these zirconia beads, even when no zirconium raw material is previously added. When zirconium oxide is contained by the abrasion of zirconia beads, the content can be controlled by adjusting the diameter of beads to be used, composition thereof, and the grinding time.

In the preparing method according to the present invention, it is desired that the particle diameter in the obtained slurry is adjusted within the ranges of (1) to (3) below.

(1) Slurry particle diameter (volume average diameter)
$D_{10}$=0.05 to 3 μm, preferably 0.05 to 2 μm
$D_{50}$=1 to 3 μm, preferably 1 to 2.5 μm
$D_{90}$=2 to 4 μm, preferably 2 to 3.5 μm (2) Slurry particle diameter (number average diameter)
$D_{50}$=0.05 to 3.0 μm, preferably 0.05 to 2 μm (3) Existing quantity of particles having the above-described slurry particle diameter (volume average diameter) of 3 μm or more is 40% by volume or less, preferably 35% by volume or less.

In order to make slurry particle diameters as described above, it can be achieved by grinding the material using the above-described grinding machine for an adequate time. When media are used in such a grinding step, various media or beads can be used. They are different depending on grinding machines, the hardness, particle diameter, and target particle diameter after grinding of the material to be ground, and are suitably selected. The above-described slurry particle diameters can also be achieved by pulverizing the material with a wet ball mill or the like and pulverizing it again with a pulverizer having a high-speed shearing force. Although such a pulverizer is not specifically limited, for example, a high-speed rotary grinding machine, an agitating-tank-type media agitating grinding machine, a distribution-pipe-type media agitating grinding machine, and the like are included. As the media used in the agitating grinding machine, various media or beads as described above can be used. Although they are different depending on grinding machines, the hardness, particle diameter, and target particle diameter after grinding of the material to be ground, the use of beads having a small particle diameter is preferable, and the use of beads having a particle diameter of 0.3 mm to 10 mm is more preferable.

The slurry particle diameter can be measured using a Microtrac Particle Size Analyzer (Model 19320-X100) manufactured by Nikkiso Co., Ltd.

As described above, by making zirconium be contained after controlling the slurry particle diameter within a certain range, zirconium can be evenly dispersed in particles without interfering with the growth of grains, and the desired effect by the addition of zirconium can be obtained.

The fired product obtained by such final firing is ground and classified. As a method for classification, existing wind-power classification, a mesh filtration method, a sedimentation method or the like is used to control the grain size to a desired particle diameter.

Thereafter, by heating the surface to a low temperature to perform an oxide coating treatment as required, the electrical resistance can be adjusted. The oxide coating treatment is performed using an ordinary rotary electric furnace, a batch electric furnace or the like, and heat treatment is performed at, for example, 300 to 700° C. The thickness of the oxide coating formed by this treatment is preferably 0.1 nm to 5 μm. If the thickness is less tan 0.1 nm, the effect of the oxide coating layer is small; and if the thickness exceeds 5 μm, magnetization is reduced or resistance becomes excessively high, and problems, such as the lowering of developing ability, arise easily. As required, reduction can be performed before the oxide coating treatment.

As methods for coating the above-described ferrite (carrier core material) with the above-described coating resin, methods known to the art, for example, brushing, a dry method, spray drying using a fluidizing bed, rotary drying, liquid immersion and drying using a universal agitator or others can be used. In order to improve the coating rate, the method using a fluidizing bed is preferred.

When baking is performed after coating the carrier core material with a resin, either an externally heating system or an internally heating system can be used, and for example, a stationary or fluidizing electric furnace, a rotary electric furnace, a burner furnace can be used, or microwave baking can also be used. Although the baking temperature differs depending on the resin to be used, the temperature of the melting point or the glass transition temperature or above is required, and in thermosetting resins or condensation cross-linking resins, the temperature must be raised until the resin cures completely.

<Electrophotographic Developer According to the Present Invention>

The electrophotographic developer according to the present invention will be described.

The toner particles that constitute the developer of the present invention include ground toner particles prepared by a grinding method, and polymerized toner particles prepared by a polymerization method. In the present invention, toner particles obtained by either method can be used.

The ground toner particles can be obtained, for example, by sufficiently mixing a binder resin, a charge controlling agent and coloring agents using a mixer such as a Henschel mixer, melting and kneaded using a twin-screw extruder or the like, cooling, grinding, classifying, adding external additives, and mixing using a mixer or the like.

Although the binder resin constituting the ground toner particles is not specifically limited, polystyrene, chloropolystyrene, styrene-chlorostyrene copolymers, styrene-acrylic ester copolymers, styrene-methacrylic acid copolymers, and further, rosin-modified maleic acid resins, epoxy resins, polyester resins, and polyurethane resins can be used. These can be used alone or in combination.

As the charge controlling agent, optional products can be used. For example, for positively charged toners, a nigrosin dye, a quaternary ammonium salt or the like can be used; and for negatively charged toners, a metal-containing monoazo dye can be used.

As coloring agents (colorants), conventionally-known dyes and pigments can be used. For example, carbon black, phthalocyanine blue, permanent red, chrome yellow, phthalocyanine green and the like can be used. In addition, external additives, such as silica powder and titania for improving the flowability of the toner and anti-aggregating properties can be added depending on the toner particles.

Polymerized toner particles are toner particles prepared by methods well known in the art, such as suspension polymerization, emulsion polymerization, emulsion aggregation, ester elongation polymerization, and phase inversion emulsification. Such polymerized toner particles are prepared by mixing and agitating a colored dispersion wherein coloring agents are dispersed in water using a surface active agent, a polymerizing monomer, a surface active agent, and a polymerization initiating agent to emulsify and disperse the polymerizing monomer in an aqueous medium, and polymerize while agitating and mixing, then, a salting agent is added to salt out the polymer particles. By filtering, cleaning and drying the particles obtained by salting out, polymerized toner particles can be obtained. Thereafter, external additives are added to the dried toner particles as required.

Furthermore, when polymerized toner particles are prepared, a fixing improving agent and a charge controlling agent can be blended in addition to the polymerizing monomer, a surface active agent, a polymerization initiator, and coloring agents; and thereby, the various characteristics of the obtained polymerized toner particles can be controlled and improved. A chain transfer agent can also be used to improve the dispersibility of the polymerizing monomer into the aqueous medium, and to adjust the molecular weight of the obtained polymer.

Although polymerizing monomers used in the preparation of the above-described polymerized toner particles are not specifically limited, for example, styrene and the derivatives thereof; ethylene unsaturated mono-olefins such as ethylene and propylene; halogenated vinyls such as vinyl chloride; vinyl esters such as vinyl acetate; and α-methylene aliphatic monocarbonic esters such as methyl acrylate, ethyl acrylate, methyl methacrylate, ethyl methacrylate, 2-ethylhexyl methacrylate, dimethylamino ester acrylates, and diethylamino ester methacrylates can be listed.

As coloring agents (colorants) used in the preparation of the above-described polymerized toner particles, conventionally-known dyes and pigments can be used. For example, carbon black, phthalocyanine blue, permanent red, chrome yellow, phthalocyanine green and the like can be used. The surface of these coloring agents can be modified using a silane coupling agent or a titanium coupling agent.

As the surface active agent used in the preparation of the above-described polymerized toner particles, an anionic surface active agent, a cationic surface active agent, an amphoteric surface active agent, or a nonionic surface active agent can be used.

Here, as the anionic surface active agent, an aliphatic salt such as sodium oleate and castor oil; an alkyl sulfate ester such as sodium lauryl sulfate and ammonium lauryl sulfate; an alkylbenzenesulfonate such as sodium dodecylbenzenesulfonate; an alkylnaphthalenesulfonate; an alkyl phosphate ester; a naphthalenesulfonate-formalin condensation product; and polyoxyethylene alkylsulfate ester; and the like can be listed. As the nonionic surface active agent, a polyoxyethylene alkylether, polyoxyethylene aliphatic ester, a sorbitan aliphatic ester, a polyoxyethylene alkylamine, glycerin, an aliphatic ester, an oxyethylene-oxypropylene block polymer, and the like can be listed. Furthermore, as the cationic surface active agent, an alkylamine salt such as laurylamine acetate; and a quaternary ammonium salt such as lauryltrimethyl ammonium chloride and stearyltrimethyl ammonium chloride, and the like can be listed. As the amphoteric surface active agent, amino carboxylic salts, alkylamino acids, and the like can be described.

The surface active agent as described above can normally be used in a quantity within a range between 0.01 and 10% by weight to the polymerizing monomer. Since the quantity of the surface active agent to be used affects the dispersion stability of the monomer, and also affects the environment dependence of the obtained polymerized toner particles, it is preferable that the surface active agent is used in a quantity within the above-described range wherein the dispersion stability of the monomer can be secured, and the environment dependence of the polymerized toner particles is difficult to be excessively affected.

For the preparation of polymerized toner particles, a polymerization initiating agent is normally used. The polymerization initiating agent includes a water-soluble polymerization initiating agent and an oil-soluble polymerization initiating agent. Either can be used in the present invention. As the water-soluble polymerization initiating agent that can be used in the present invention, for example, persulfates such as potassium persulfate and ammonium persulfate, and water-soluble peroxide compounds can be listed; and as the oil-soluble polymerization initiating agent, for example, azo compounds such as azobisisobutyronitrile, and oil-soluble peroxide compounds can be listed.

When a chain transfer agent is used in the present invention, for example, mercaptans such as octyl mercaptan, dodecyl mercaptan, and tert-dodecyl mercaptan; and carbon tetrabromide and the like can be listed as the chain transfer agent.

Furthermore, when the polymerized toner particles used in the present invention contain a fixing improving agent, natural wax such as carnauba wax, or olefin wax such as polypropylene and polyethylene can be used.

When the polymerized toner particles used in the present invention contain a charge controlling agent, the charge controlling agent to be used is not specifically limited, and nigrosin dyes, quaternary ammonium salts, organic metal complexes, metal-containing monoazo dyes or the like can be used.

As the external additive used for the improvement of the flowability of polymerized toner particles or the like, silica, titanium oxide, barium titanate, fine fluorine resin particles, fine acrylic resin particles and the like can be listed; and these can be used alone, or in combination.

Furthermore, as the salting agent used for the separation of polymerized particles from the aqueous medium, metal salts, such as magnesium sulfate, aluminum sulfate, barium chloride, magnesium chloride, calcium chloride and sodium chloride, can be listed.

The average particle diameter of toner particles prepared as described above is within a range between 2 and 15 μm, preferably 3 and 10 μm, and the polymerized toner particles have higher uniformity of particles than ground toner particles. If a toner particle is smaller than 2 μm, the charging ability lowers, and fog or toner scattering is easily caused; and the toner particle exceeds 15 μm causes the deterioration of the image quality.

An electrophotographic developer can be obtained by mixing the carrier and the toner prepared as described above. The mixing ratio of the carrier and the toner, that is, the toner concentration is preferably set at 3 to 15%. If the mixing ratio is less than 3%, the desired image density is difficult to obtain; and if it exceeds 15%, toner scattering or fog occurs easily.

The developer mixed as described above can be used in digital copying machines, printers, facsimiles, printers and the like that use a developing system to perform reversal development of the electrostatic latent images formed in a latent-image holder having an organic photoconductor layer with the magnetic brush of a two-component developer having a toner and a carrier while imparting a bias electric field. It can also be applied to full-color machines that use an alternate electric field as the method to overlapping an AC bias to a DC bias when a developing bias is impressed from the magnetic brush to the electrostatic latent image side.

The present invention will be specifically described below on the basis of examples and the like.

EXAMPLE 1

To 100 parts by weight of ferrite raw materials weighed and mixed so as to have the composition of MnO: 35 mol %, MgO: 14 mol %, $Fe_2O_3$: 50 mol %, and SrO: 1 mol %, an adequate quantity of zirconium oxide so that the zirconium content becomes about 400 ppm after firing was added, and the mixture was ground and mixed for 3 hours using a dry vibration mill, and was palletized using a compression molding machine. Thereafter, the mixture was held at 950° C. for 1 hour to perform preliminary firing. This was ground for 5 hours using a wet ball mill. As the media of the wet ball mill, stainless-steel beads having a diameter of about 3 mm (⅛ inch) were used. The slurry particle diameters of the obtained slurry were as shown in Table 1.

Adequate quantities of a dispersant and a binder were added to the slurry, then granulated using a spray dryer, dried, and held in an electric furnace of a temperature of 1250° C. and an oxygen concentration of 1.5% for 4 hours to perform final firing. Thereafter, crushing and classifying were performed to adjust particle size, and thereafter, a low-magnetic-force product was separated by magnetic separation, and the core material of ferrite particles was obtained.

These ferrite particles were used as the core material, and a silicone resin (product name: SR-2411, solid content: 20% by weight, produced by Dow Corning Toray Silicone Co., Ltd.) and 2% by weight of γ-aminopropyl triethoxysilane to the solid content of the resin was weighed, dissolved in toluene, and 0.5% by weight of the solution to the carrier core material was applied to the core material using a fluidized bed coater and baked at 250° C. for 3 hours to obtain the ferrite carrier coated with the above-described resin.

The average particle diameter of the obtained carrier was 35.2 μm, and the content of zirconium was 380 ppm. Various characteristics and properties (resistance, specific surface area, shape factor, magnetization, and apparent density) of the carrier are shown in Table 2. The methods for measuring various characteristics and properties shown in Tables 1 and 2 are as described above.

EXAMPLE 2

Materials weighed and mixed so as to have the composition of MnO: 39 mol %, MgO: 10 mol %, $Fe_2O_3$: 50 mol %, and SrO: 1 mol % were ground and mixed using a dry vibration mill for 3 hours, and palletized using a compression molding machine. Thereafter, the mixture was held at 950° C. for 1 hour to perform preliminary firing. This was ground for 2 hours using a wet ball mill. As the media of the wet ball mill, stainless-steel beads having a diameter of about 3 mm (⅛ inch) were used. Then, grinding was performed using a distribution-pipe-type media agitating grinding machine. As the media in this grinding, zirconia beads having a diameter of about 0.65 mm were used. The slurry particle diameters of the obtained slurry were as shown in Table 1.

Adequate quantities of a dispersant and a binder were added to the slurry, then granulated using a spray dryer, dried, and held in an electric furnace of a temperature of 1250° C. and an oxygen concentration of 1.5% for 4 hours to perform final firing. Thereafter, crushing and classifying were performed to adjust particle size, and thereafter, a low-magnetic-force product was separated by magnetic separation, and the core material of ferrite particles was obtained. Thereafter, resin coating was performed in the same manner as in Example 1 and the resin-coated ferrite carrier was obtained.

Various characteristics and properties (Zr content, average particle diameter, resistance, specific surface area, shape factor, magnetization, and apparent density) of the carrier are shown in Table 2.

EXAMPLE 3

Materials weighed and mixed so as to have the composition of MnO: 39 mol %, MgO: 10 mol %, $Fe_2O_3$: 50 mol %, and SrO: 1 mol % were ground and mixed using a dry vibration mill for 3 hours, and palletized using a compression molding machine. Thereafter, the mixture was held at 950° C. for 1 hour to perform preliminary firing. This was ground for 2 hours using a wet ball mill. As the media of the wet ball mill, stainless-steel beads having a diameter of about 3 mm (⅛ inch) were used. Then, grinding was performed using a agitating-tank-type media agitating grinding machine for 2 hours. As the media in this grinding, zirconia beads having a diameter of about 0.65 mm were used. The slurry particle diameters of the obtained slurry were as shown in Table 1.

Adequate quantities of a dispersant and a binder were added to the slurry, then granulated using a spray dryer, dried, and held in an electric furnace of a temperature of 1250° C. and an oxygen concentration of 1.5% for 4 hours to perform final firing. Thereafter, crushing and classifying were performed to adjust particle size, and thereafter, a low-magnetic-force product was separated by magnetic separation, and the core material of ferrite particles was obtained. Thereafter, resin coating was performed in the same manner as in Example 1 and the resin-coated ferrite carrier was obtained.

Various characteristics and properties (Zr content, average particle diameter, resistance, specific surface area, shape factor, magnetization, and apparent density) of the carrier are shown in Table 2.

COMPARATIVE EXAMPLES

Comparative Example 1

Materials weighed and mixed so as to have the composition of MnO: 20 mol %, and $Fe_2O_3$: 80 mol % were ground and mixed using a dry vibration mill, and palletized using a compression molding machine. Thereafter, the mixture was held at 950° C. for 1 hour to perform preliminary firing. This was ground for 2 hours using a wet ball mill. As the media of the wet ball mill, stainless-steel beads having a diameter of about 3 mm (⅛ inch) were used. The slurry particle diameters of the obtained slurry were as shown in Table 1.

Adequate quantities of a dispersant and a binder were added to the slurry, then granulated using a spray dryer, dried, and held in an electric furnace of a temperature of 1290° C. and an oxygen concentration of 0.1% for 4 hours to perform final firing. Thereafter, crushing and classifying were performed to adjust particle size, and thereafter, a low-magnetic-force product was separated by magnetic separation, and the core material of ferrite particles was obtained. Thereafter, resin coating was performed in the same manner as in Example 1 and the resin-coated ferrite carrier was obtained.

Various characteristics and properties (Zr content, average particle diameter, resistance, specific surface area, shape factor, magnetization, and apparent density) of the carrier are shown in Table 2.

Comparative Example 2

To 100 parts by weight of MnO: 48 mol %, MgO: 2 mol %, and $Fe_2O_3$: 50 mol %, 0.5 parts by weight of $ZrO_2$ was added, and the mixture was ground and mixed for 3 hours using a dry vibration mill, and was palletized using a compression molding machine. Thereafter, the mixture was held at 950° C. for 1 hour to perform preliminary firing. This was ground for 2 hours using a wet ball mill. As the media of the wet ball mill, stainless-steel beads having a diameter of about 3 mm (⅛ inch) were used. The slurry particle diameters of the obtained slurry were as shown in Table 1.

Adequate quantities of a dispersant and a binder were added to the slurry, then granulated using a spray dryer, dried, and held in an electric furnace of a temperature of 1250° C. and an oxygen concentration of 0.3% for 4 hours to perform final firing. Thereafter, crushing and classifying were performed to adjust particle size, and thereafter, a low-magnetic-force product was separated by magnetic separation, and the core material of ferrite particles was obtained. Thereafter, resin coating was performed in the same manner as in Example 1 and the resin-coated ferrite carrier was obtained.

Various characteristics and properties (Zr content, average particle diameter, resistance, specific surface area, shape factor, magnetization, and apparent density) of the carrier are shown in Table 2.

marketed by Toshiba Tec Corporation. The image evaluation at that time was ranked under the following conditions.

(White Spots)

Development was performed under adequate exposure conditions, and the level of white spots on the image was ranked.

◎: No white spots in 10 sheets of A-3 paper
○: 1 to 5 white spots in 10 sheets of A-3 paper
Δ: 6 to 10 white spots in 10 sheets of A-3 paper
▲: 11 to 20 white spots in 10 sheets of A-3 paper
X: 21 or more white spots in 10 sheets of A-3 paper (Resolution)

Development was performed under adequate exposure conditions, and resolution was observed and ranked.

◎: Very good
○: Good
Δ: Usable level
▲: Poor
X: Very poor

TABLE 1

| | | Slurry particle diameter before sintering | | | | |
|---|---|---|---|---|---|---|
| | | Volume average diameter | | | | |
| | Zr content (ppm) | $D_{10}$ (μm) | $D_{50}$ (μm) | $D_{90}$ (μm) | Content of particles larger than 3 μm (vol %) | Number average diameter $D_{50}$ (μm) |
| Example 1 | 380 | 0.21 | 1.60 | 2.47 | 2.51 | 0.18 |
| Example 2 | 105 | 1.17 | 2.13 | 3.03 | 10.64 | 0.18 |
| Example 3 | 58 | 1.97 | 2.65 | 3.58 | 36.47 | 2.31 |
| Comparative Example 1 | 38 | 2.15 | 3.03 | 4.37 | 51.49 | 2.55 |
| Comparative Example 2 | 5300 | 2.11 | 2.87 | 3.82 | 41.22 | 2.46 |

TABLE 2

| | Carrier characteristics | | | | | | | Image evaluation | |
|---|---|---|---|---|---|---|---|---|---|
| | Average particle diameter (μm) | Resistance of ferrite core material (Ω) | Resistance of ferrite core material after resin coating (Ω) | Specific surface area ($m^2$/g) | Shape factor SF-2 | Magnetization (emu/g) | Apparent density (g/$cm^3$) | White spot | Resolution |
| Example 1 | 35.2 | $7.5 \times 10^6$ | $2.2 \times 10^{10}$ | 0.0722 | 110.2 | 69.0 | 2.18 | ○ | ○ |
| Example 2 | 35.3 | $6.0 \times 10^6$ | $3.5 \times 10^{10}$ | 0.0757 | 106.0 | 65.0 | 2.19 | ◎ | ◎ |
| Example 3 | 35.0 | $7.5 \times 10^6$ | $1.2 \times 10^{10}$ | 0.1170 | 109.1 | 67.0 | 2.08 | ○ | Δ |
| Comparative Example 1 | 32.2 | $7.5 \times 10^4$ | $8.6 \times 10^7$ | 0.2017 | 118.2 | 92.0 | 1.92 | X | X |
| Comparative Example 2 | 36.5 | $7.5 \times 10^5$ | $5.6 \times 10^8$ | 0.1089 | 138.6 | 67.0 | 1.85 | Δ | X |

(Example of Developer Preparation)

The ferrite carriers obtained in Examples 1 to 3 and Comparative Examples 1 to 2, and a toner for commercially available FANTASIA 200 produced by Toshiba Tec Corporation were used to prepare developers so that the toner concentration became 7%.

The image evaluation of the developer (white spots and resolution) was performed. The results are shown in Table 2. The image evaluation was performed using a FANTASIA 200

As is obvious from the results of Tables 1 and 2, the ferrite carriers of Examples 1 to 3 containing zirconium within the specific range have higher resistance (for ferrite core material and after resin coating) and larger apparent density than the ferrite carrier of Comparative Example 1 containing zirconium within the range of accompanying impurity, and the ferrite carrier of Comparative Example 2 containing excessive zirconium. Also in image evaluation using developers, the developers using the ferrite carriers of Examples 1 to 3 are superior to the developers using the ferrite carriers of Comparative Examples 1 to 2 in both white spots and resolution, and the developer using the ferrite carrier of Example 2 is particularly superior.

In Table 1, Example 2 has a slurry particle diameter before sintering, which is considered to be within an adequate range, and when the ferrite carrier obtained by firing this is used for the developer, favorable image characteristics can be obtained.

INDUSTRIAL APPLICABILITY

Since the ferrite carrier for an electrophotographic developer according to the present invention has a high dielectric breakdown voltage, the occurrence of charge leakage can be suppressed. Therefore, since the electrophotographic developer using this ferrite carrier produces high-quality images, it can be widely used in the fields of full-color machines requiring high image quality, and high-speed machines requiring the reliability and durability of image maintaining. By the preparing method according to the present invention, the above-described ferrite carrier can be obtained in industrial-scale productivity.

What is claimed is:

1. A ferrite carrier for an electrophotographic developer wherein the ferrite carrier is represented by formula (1)

$$(MnO)x(MgO)y(Fe_2O_3)z \quad (1);$$

wherein x=35-45 mol %, y=5-15 mol %, z=40-60 mol %, and x+y+z=100 mol %; and wherein a part of MnO and/or MgO is replaced by an oxide of strontium and wherein the ferrite carrier contains a content of 40 ppm to 500 ppm of zirconium.

2. The ferrite carrier for an electrophotographic developer according to claim 1, wherein the surface of said carrier is coated with a resin.

3. An electrophotographic developer comprising the ferrite carrier according to claim 1 and a toner.

4. The ferrite carrier of claim 1, wherein said carrier has a saturation magnetization level between approximately 50 emu/g to approximately 100 emu/g.

* * * * *